United States Patent [19]

Magers

[11] Patent Number: 4,728,311

[45] Date of Patent: Mar. 1, 1988

[54] TOY HELICOPTER

[76] Inventor: Ronald G. Magers, 79 Eastern Ave., Essex, Mass. 01929

[21] Appl. No.: 827,774

[22] Filed: Feb. 7, 1986

[51] Int. Cl.[4] ..... A63H 21/02; A63H 27/00; A63H 33/26

[52] U.S. Cl. ..... 446/228; 446/232; 446/420; 446/485

[58] Field of Search ..... 446/228, 232, 231, 230, 446/229, 236, 242, 246, 484, 420, 241, 485

[56] References Cited

U.S. PATENT DOCUMENTS

| | | | |
|---|---|---|---|
| Re. 31,667 | 9/1984 | Knauff | 446/232 X |
| 2,411,596 | 11/1946 | Shapiro . | |
| 2,469,144 | 5/1949 | Baggott . | |
| 2,642,698 | 6/1953 | Fishburne . | |
| 2,732,656 | 1/1956 | Cohn . | |
| 3,093,929 | 6/1963 | Robbins et al. . | |
| 3,391,488 | 7/1968 | Cook . | |
| 3,411,236 | 11/1968 | Fileger et al. | 446/420 |
| 3,613,305 | 10/1971 | Suzuki . | |
| 3,686,790 | 8/1972 | Winston . | |
| 3,807,087 | 4/1974 | Staats et al. . | |
| 4,610,638 | 9/1986 | Iwad et al. | 446/241 |

FOREIGN PATENT DOCUMENTS

| | | | |
|---|---|---|---|
| 2134399 | 8/1984 | United Kingdom | 446/232 |

*Primary Examiner*—Mickey Yu

*Attorney, Agent, or Firm*—Neuman, Williams, Anderson & Olson

[57] ABSTRACT

A toy helicopter is provided having a rotor that gradually accelerates to simulate the start-up of a full-scale helicopter, wherein the gradual acceleration is induced by frictional interaction between the surface of a drive shaft and the surface of a bore formed in the rotor hub. Actuation is accomplished by lifting an actuating shaft which extends from the rotor hub and drive shaft to activate a motor; returning the actuating shaft to its resting position deactivates the toy. The toy also provides a flashing light and audio mechanism to further simulate the operation of a full-scale helicopter.

13 Claims, 9 Drawing Figures

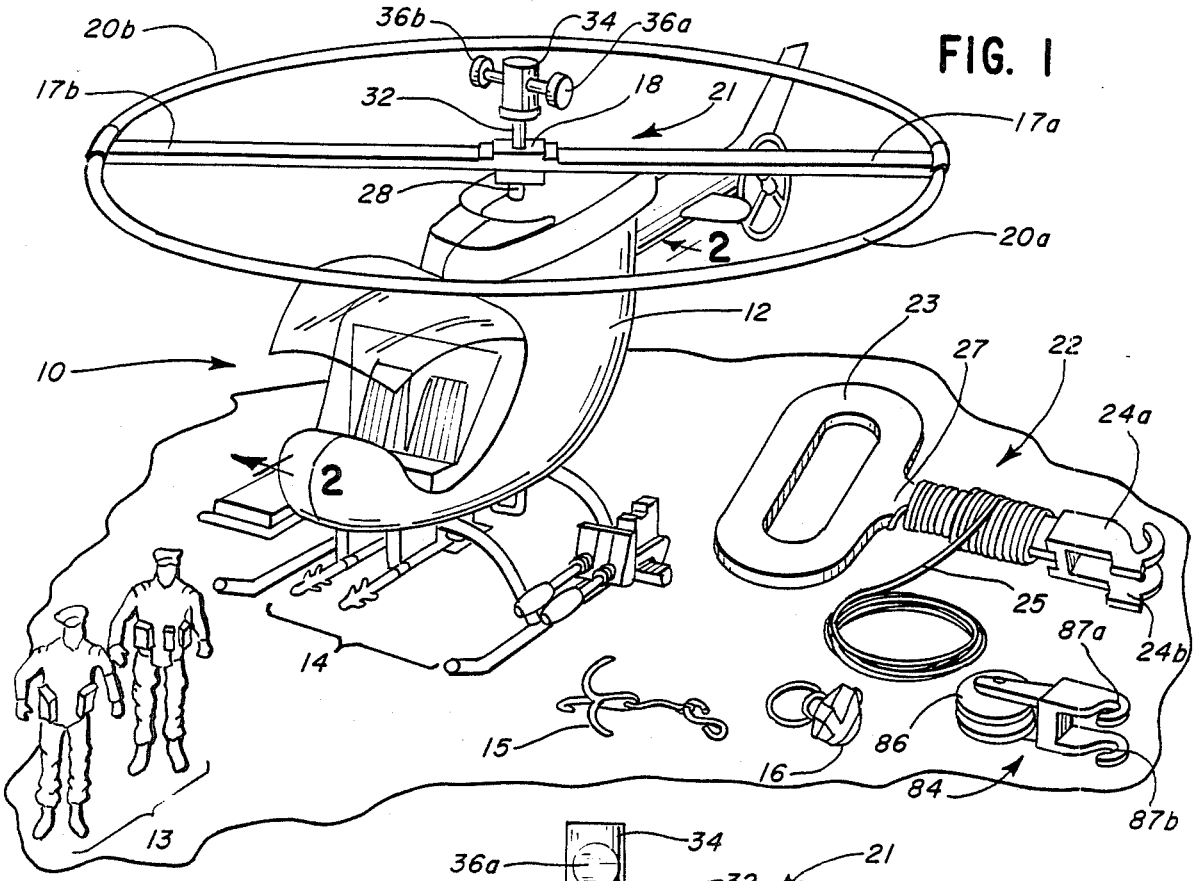
FIG. 1
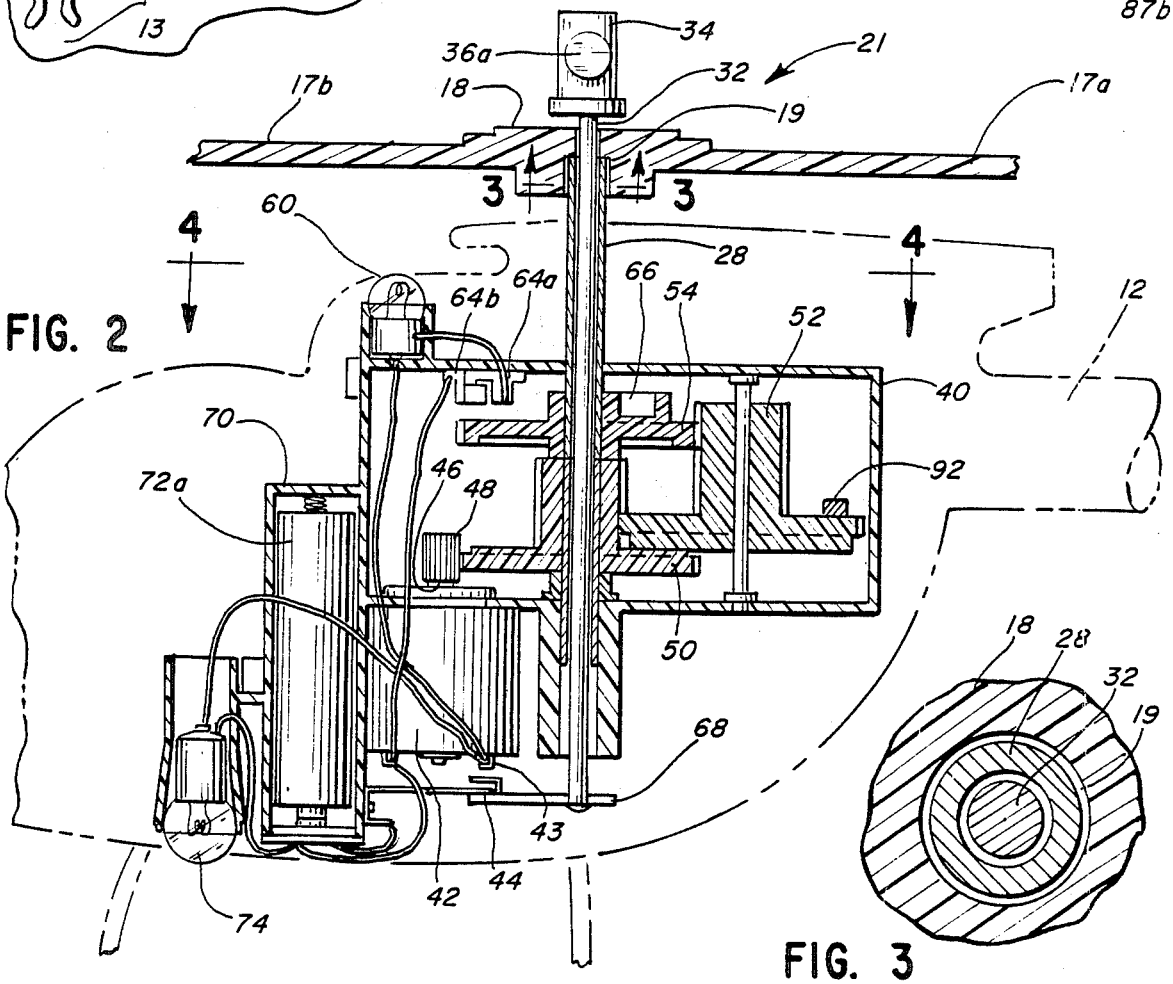
FIG. 2
FIG. 3

FIG. 4
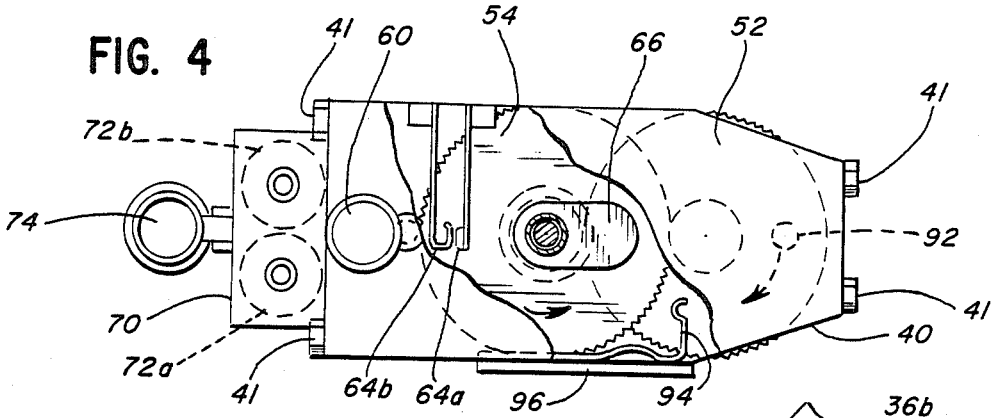
FIG. 5
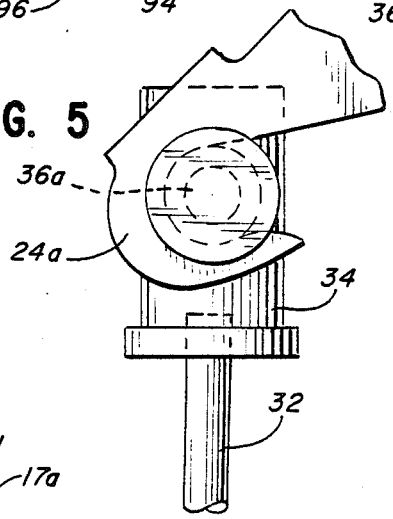
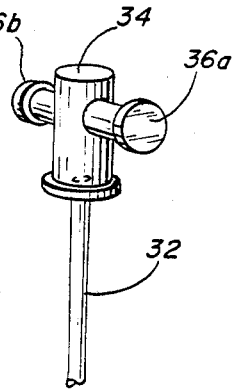
FIG. 6
FIG. 7
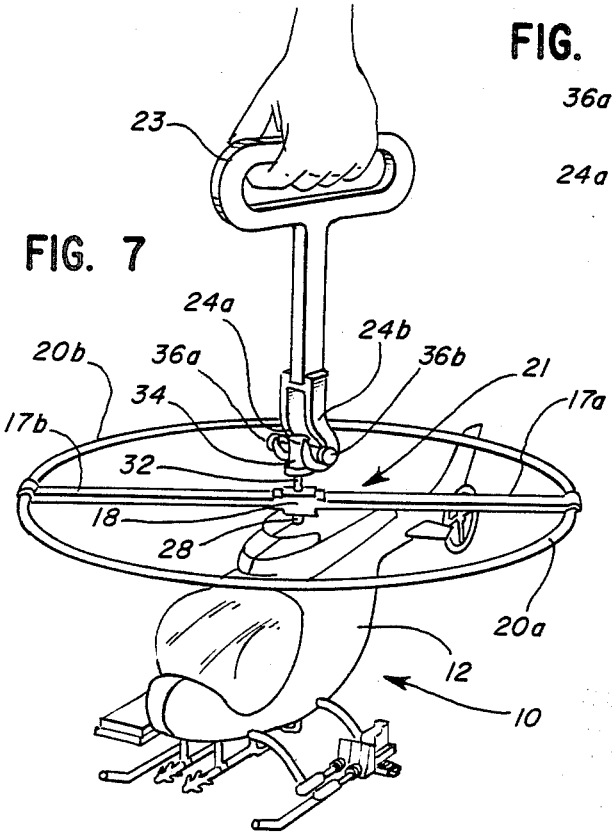
FIG. 9
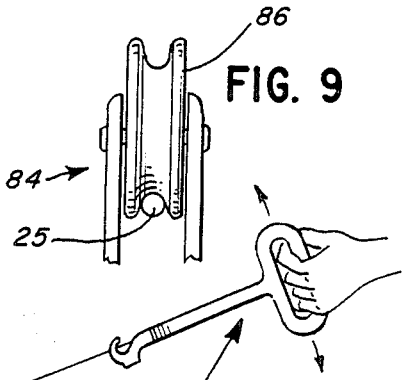
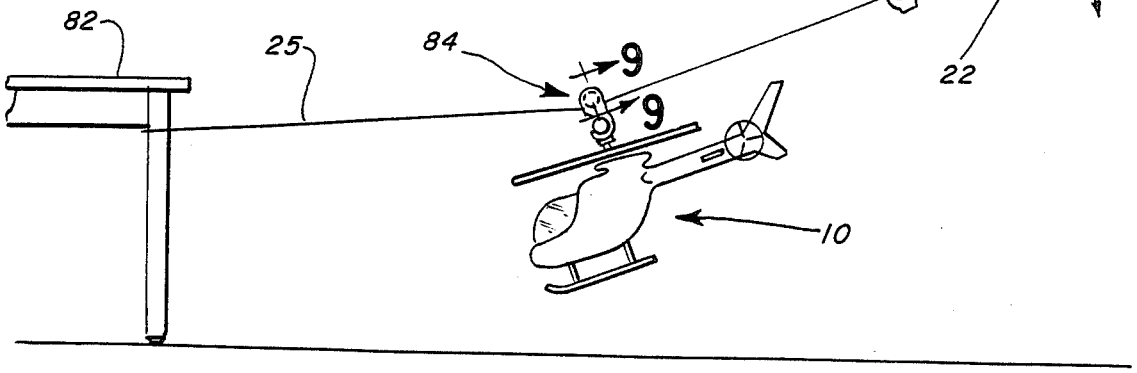
FIG. 8

TOY HELICOPTER

BACKGROUND OF THE INVENTION

1. Field of the Invention

This invention relates generally to a toy helicopter, and pertains more specifically to a toy helicopter having a rotor that, once actuated, gradually accelerates to simulate the start-up of a full-scale helicopter. In the preferred embodiment, rotational acceleration of the rotor is induced by frictional interaction between the surface of a tubular drive shaft and the surface of a bore formed in the rotor hub. Actuation of the toy is accomplished by the simple lifting of an actuating shaft which extends from the rotor hub and from within the tubular drive shaft. The toy is deactivated by allowing the actuating shaft to return to its rest position, such as by placing the toy on a horizontal surface.

The toy helicopter of the present invention also incorporates a flashing light mechanism to further simulate the operation of a full-scale helicopter. The light flashes in time with the rotation of the drive shaft, thereby recreating the lighting effect associated with full-scale helicopters. Another feature of the present invention is an audio mechanism which imparts a sound which simulates that of a full-scale helicopter in operation.

2. Description of the Prior Art

Children prefer toys that are both realistic and fun to operate. To satisfy this preference, toy makers expend great effort to simulate in their miniature replicas the features of the full-scale items they depict. For example, miniature automobiles will frequently depict in substantial detail various miniature automotive components such as the steering wheel, transmission and exhaust systems.

In the past, various toy helicopters have been devised for use by children. Most of these toys embody some of the features of the full-scale helicopters they depict. The degree of entertainment provided by these toys is directly related to the realism evoked by their features and operation. One such feature involves the start-up of the toy helicopter, which in the full-scale item constitutes a gradual buildup of rotational velocity of the rotor. To simulate this type of start-up in a miniature toy replica, one must likewise provide a way to gradually induce acceleration of the toy's rotor. However, providing such realistic start-up in a toy increases the complexity of the design and hence the cost to manufacture the toy and, moreover, may detract from the toy's ease of operation.

A conventional toy helicopter is depicted in Shapiro et al. U.S. Pat. No. 2,411,596. In this patent, the rotor is rotated by a drive shaft that is rigidly affixed to the rotor. Thus, a gradual increase in rotor speed during start-up is not provided in the Shapiro et al. design, and the design therefore lacks an important aspect of realism.

In Robbins et al. U.S. Pat. No. 3,093,929, a toy helicopter design is provided which employs belts to transmit rotary movement to two rotor shafts. However, the patent contains no teaching that gradual acceleration of the rotors is even possible using its belt-driven design.

In Cohn U.S. Pat. No. 2,732,656, a toy helicopter is described in which a coil spring is used to transmit rotational movement from the shaft of a hand-wound motor to a rotor shaft. While the Cohn patent states that the coil spring is in frictional engagement with both shafts, there is no suggestion or teaching that gradual acceleration of the rotor can be accomplished using its slipping spring design.

The present invention is directed to overcoming the lack of realism inherent in the prior art. In the present invention, a toy helicopter is provided in which gradual acceleration of the rotor during start-up is achieved to provide a realistic simulation of the start-up of a full-scale helicopter. The toy is actuated by simply lifting a shaft extending from the rotor hub. A flashing light mechanism and an audio mechanism enhance the realism to the toy. The present invention accomplishes these goals through a safe, simple design adapted for high speed, low cost manufacture.

OBJECTS OF THE INVENTION

An object of the invention is to provide a toy helicopter that simulates the start-up of a full-scale helicopter by inducing gradual rotational acceleration of the rotor upon actuation of the toy.

Another object is to provide a toy helicopter that is safe to operate and in which the rotor blades will yield when interfered with, such as when a child places a finger in the path of a rotor blade.

Still another object of the invention is to provide a toy helicopter that be hand-carried or suspended from a cable during operation.

A further object of the invention is to provide a toy helicopter that is actuated by simply lifting the helicopter off the ground, and which is deactivated by returning the helicopter to a horizontal surface.

Yet another object is to provide a toy helicopter having flashing lights and an audio mechanism that simulate those features in a full-scale helicopter.

Still further, an object of this invention is to provide a toy that is relatively simple to operate and that will be intriguing and entertaining.

Further and additional objects will appear from the description, accompanying drawings and appended claims.

SUMMARY OF THE INVENTION

The above and other objects are accomplished in accordance with this invention by providing a toy comprising a body, a motor, a switch for actuating the motor, and a drive shaft operatively associated with the motor. A rotor having a hub and a bore formed therein is mounted on and loosely frictionally engages the drive shaft. Actuation of the motor rotates the drive shaft to induce gradual rotational acceleration of the rotor as a result of frictional interaction between the cooperating surfaces of the drive shaft and the hub bore.

In the preferred embodiment, the toy comprises a body in the shape of a miniature helicopter replica. The motor has a rotating shaft with a pinion gear mounted on its distal end. A gear assembly meshes with the motor pinion gear and transmits rotary movement from the motor pinion gear to a drive shaft. In the preferred embodiment, the drive shaft is tubular, and an actuating shaft extends from the hub of the rotor and from within the tubular drive shaft. An actuating arm is operatively associated at one end with the internally projecting end of the actuating shaft, and operatively associated at the arm's other end with the motor switch. Axial movement of the actuating shaft actuates the switch and energizes the toy.

The preferred embodiment of the toy helicopter further comprises carrying means for grasping the externally projecting end of the actuating shaft. The carrying means comprises either a handle for hand-carrying the toy or a pulley for suspending the toy from a cable.

A flashing light mechanism is provided in the preferred embodiment comprising a light bulb and an electrical circuit connected to the light bulb comprising a power source and two normally separated contact members. A tongue associated with one gear of the gear assembly urges the contact members together to complete the electrical circuit and actuate the light bulb at least once per revolution of the gear.

An audio mechanism is also provided in the preferred embodiment comprising a striker associated with one gear of the gear assembly and a diaphragm. The striker strikes the diaphragm as the one gear rotates to emit a sound simulating that of a full-scale helicopter in operation.

BRIEF DESCRIPTION OF THE DRAWINGS

FIG. 1 is a perspective view of a toy helicopter exemplifying the invention, shown in conjunction with its associated accessories.

FIG. 2 is a sectional view of the toy helicopter of FIG. 1, taken in the direction of arrows 2—2 of FIG. 1, illustrating the actuation mechanism, the rotor assembly, the flashing light mechanism and the audio mechanism.

FIG. 3 is an enlarged section view of a portion of FIG. 2, taken in the direction of arrows 3—3 in FIG. 2, showing in cross-section the shafts residing within the bore of the rotor hub.

FIG. 4 is a top view, partially in section, taken in the direction of arrows 4—4 of FIG. 2, illustrating the flashing light and audio mechanisms.

FIG. 5 is an enlarged side view illustrating how the attachment of the carrying handle or pulley to the end cap of the toy's actuating shaft.

FIG. 6 is a perspective view of the actuating shaft of the toy of the present invention, illustrating the projecting posts to which the carrying handle and pulley are attached.

FIG. 7 is a perspective view illustrating the manipulation of the toy using the toy's carrying handle.

FIG. 8 is a perspective view showing the manipulation of the toy while it is suspended from a cable by the toy's pulley.

FIG. 9 is a side view, taken in the direction of arrows 9—9 of FIG. 8, illustrating the pulley used to suspend the toy helicopter from a cable.

DETAILED DESCRIPTION OF THE PREFERRED EMBODIMENT

Turning to the drawings, a toy helicopter constructed in accordance with the invention is denoted generally by the reference numeral 10. As illustrated in FIG. 1, toy helicopter 10 comprises a body 12 formed in the shape of a miniature helicopter replica. The shape of body 12 is not critical, and may for example be an airplane replica or a replica of any suitable craft which employs a rotor.

Various accessories designed to enhance the entertainment value of the toy are shown associated with helicopter 10 in FIG. 1, including action figures 13, undercarriage accessories 14 (including belly rockets, machine gun and medical evacuation stretcher), a grapnel 15 for use in retrieving objects with helicopter 10, and suspension backpack 16 which snaps onto action FIGS. 13 to allow action figures 13 to be suspended from helicopter 10.

As shown in FIG. 1, helicopter 10 comprises an externally projecting tubular drive shaft 28. Mounted on tubular drive shaft 28 is rotor assembly 21 comprising rotor hub 18, rotor blades 17*a* and 17*b* and rotor rings 20*a* and 20*b*. An actuating shaft 32 projects from within rotor hub 18 and tubular shaft 28. An end cap 34 having a pair of projecting posts 36*a* and 36*b* is mounted on the externally projecting end of actuating shaft 32, as shown. Helicopter 10 is actuated by lifting by end cap 34 in the direction indicated by the arrow in FIG. 1 and as described in more detail below.

Means for manipulating helicopter 10 are also illustrated in FIG. 1. Handle 22 comprises hand grip 23, stem 27 and projecting hooks 24*a* and 24*b*. Hooks 24*a* and 24*b* grasp and engage projecting posts 36*a* and 36*b*, respectively, on end cap 34 to lift the toy and thereby induce axial movement of actuating shaft 32. Handle stem 27 also serves as a reel for cable 25 from which helicopter 10 can be suspended when using pulley 84. Cable 25 is normally a rope or cord, but may also be formed of a solid wire, wire strands, solid plastic, strands of plastic, etc. As shown in FIG. 1, pulley 84 comprises pulley wheel 86, which in operation straddles cable 25, and projecting hooks 87*a* and 87*b* for grasping and engaging projecting posts 36*a* and 36*b*, respectively.

The operational components of helicopter 10 are illustrated in detail in FIG. 2. Electric motor 42 is rigidly mounted in gear assembly housing 40. Motor 42 has a rotating shaft 46 with a pinion gear 48 on its distal end, as shown. Pinion gear 48 is in mesh with drive gear 50. Tubular drive shaft 28 is mounted in and projects upwardly from the central portion of drive gear 50. As shown in FIG. 2, rotor hub 18 is mounted on the externally projecting end of tubular drive shaft 28. The wall of cylindrical bore 19 loosely frictionally engages the cooperating outside wall of tubular drive shaft 28. Upon rotation of tubular drive shaft 28, friction is generated between the outside wall of shaft 28 and the wall of bore 19, and friction is also generated between the annular end surface defined by the cross-section of shaft 28 and the annular bottom surface of bore 19 to induce gradual rotational acceleration of rotor assembly 21. Because of the frictional interaction between the annular end surface of shaft 28 and the annular bottom surface of bore 19, shaft 28 must be thick enough in cross-section to prevent shaft 28 from cutting into rotor hub 18. A suitable wall thickness for shaft 28 is 0.03 inches.

The actuating mechanism for helicopter 10 is also illustrated in FIG. 2. Actuating shaft 32 has an end cap 34 mounted on its externally projecting end. End cap 34 has a pair of projecting posts, one of which is illustrated in FIG. 2 as post 36*a*. An actuating arm 68 is mounted on the internally projecting end of actuating shaft 32. The lifting of arm 68 pulls resilient conductive member 44 into contact with motor contact member 43 to complete the electrical circuit from the batteries within battery housing 70, one battery of which is shown in FIG. 2 as battery 72*a*, and thereby energize motor 42. As shown in FIG. 3, actuating shaft 32 passes through rotor hub 18 and within tubular drive shaft 28.

The flashing light mechanism of helicopter 10 is also illustrated in FIG. 2. Light bulb 60 is mounted on the exterior of gear assembly housing 40. Bulb 60 is connected via an electrical circuit to the batteries (illustrated in FIG. 4 as batteries 72*a* and 72*b*) and two normally separated contact members 64*a* and 64*b*. Gear 54 is formed with an oblong tongue 66 projecting from the central portion of gear 54, shown in detail in FIG. 4. Gear 54 is in mesh with gear 52 which is in mesh with drive gear 50. Rotation of drive gear 50 thereby induces rotation of gear 54 and tongue 66. As shown in FIGS. 2 and 4, contact members 64*a* and 64*b* are mounted on gear assembly housing 40 such that tongue 66 urges contact member 64*a* into contact with contact member 64*b* once per revolution of gear 54 to complete the electrical circuit and cause bulb 60 to flash.

Helicopter 10 also includes a light bulb 74, as shown in FIGS. 2 and 4, which is energized upon activation of motor 42 to simulate the searchlight of a full-scale helicopter.

The audio mechanism of helicopter 10 which simulates the sound of a full-scale helicopter is illustrated in FIG. 4. As shown, stub shaft 92 is mounted on gear 52. As stub shaft 92 rotates with gear 52, stub shaft 92 flexes resilient striker arm 94 away from plastic striker plate 96. Continued rotation of gear 52 causes stub shaft 92 to move out of contact with striker arm 94, releasing arm 94 which then snaps back to strike plastic striker plate 96 and impart a sound which simulates that of a full-scale helicopter.

FIG. 5 illustrates the grasping and engagement of helicopter 10 with the hook portion of handle 22 or pulley 84. As shown, each hook press fits onto its corresponding projecting post.

FIG. 6 illustrates in detail the structure at the externally projecting end of actuating shaft 32, showing end cap 34 and projecting posts 36*a* and 36*b* from which helicopter 10 is manipulated by handle 22 or suspended by pulley 84.

FIG. 7 illustrates the manipulation of toy helicopter 10 with handle 22. As end cap 34 is lifted by hooks 24*a* and 24*b* of handle 22, axial movement of actuating shaft 32 activates motor 42. When helicopter 10 is returned to a horizontal position and handle 22 is released, end cap 34 and actuating shaft 32 return to their rest positions due to gravity and the action of resilient conductive member 44, which moves out of contact with contact member 43. Motor 42 is thereby inactivated, and rotor assembly 21 will eventually coast to a halt.

FIG. 8 illustrates the manipulation of helicopter 10 with pulley 84. As shown, one end of cable 25 is secured to a relatively rigid solid object, shown in FIG. 8 as table 82. The other end of cable 25 is fastened to handle 22 which is then manipulated up or down as shown to direct helicopter 10 along cable 25. Lifting helicopter 10 from its rest position on a horizontal surface by raising cable 25 and pulley 84 activates motor 42. Replacement of helicopter 10 onto a horizontal surface by lowering cable 25 and pulley 84 deactivates motor 42.

FIG. 9 illustrates the positioning of pulley 84 on cable 25. As shown, pulley wheel 86 straddles cable 25 so that when hooks 87*a* and 87*b* of pulley 84 (not shown) grasp projecting posts 36*a* and 36*b* (also not shown), movement of helicopter 10 is permitted along cable 25.

From the foregoing it will be seen that the present invention brings to the art a new and improved toy helicopter which overcomes many of the drawbacks of conventional toy helicopters. Specifically, simple lifting of an actuating shaft projecting from the rotor hub energizes the helicopter motor. Moreover, the helicopter of the present invention is surprisingly realistic by virtue of the gradual acceleration of the rotor during start-up to simulate the start-up of a full-scale helicopter. It will also be noted that the toy helicopter of the present invention incorporates an important safety feature. During operation of the toy, should the rotor blades be interfered with for any reason, the tubular drive shaft will undergo slippage within the bore of the rotor hub. Thus, should a child's finger or hand be placed in front of the whirling rotor blades, no injury will occur since the blades will stop their rotation because of the slippage effect between the drive shaft and the rotor hub. Moreover, it will be observed that in the present toy helicopter, the flashing light and audio mechanisms augment the realism evoked by the toy.

While particular embodiments and applications of the present invention have been shown, it will be understood, of course, that the invention is not limited thereto since modifications may be made by those skilled in the art, particularly in light of the foregoing teachings. It is therefore contemplated by the appended claims to cover any such modifications as incorporate those features that come within the true spirit and scope of the invention.

What is claimed is:

1. A toy comprising:
a body;
a motor having a rotating shaft with a pinion gear mounted on its distal end;
a switch for actuating said motor;
a gear assembly in mesh with said pinion gear, said gear assembly comprising at least one gear;
a tubular drive shaft projecting from the central portion of said at least one gear;
a rotor having a hub with a bore formed therein, said rotor mounted on and loosely frictionally engaging said drive shaft;
an actuating shaft passing through said rotor hub and within said tubular shaft and through the central portion of said at least one gear;
an actuating arm operatively associated at one end with the internally projecting end of said actuating shaft, said actuating arm operatively associated at said arm's other end with said switch;
whereby axial movement of said actuating shaft actuates said motor to induce rotation of said tubular drive shaft to thereby induce gradual rotational acceleration of said rotor as a result of frictional interaction between cooperating surfaces of said drive shaft and said rotor hub.

2. A toy as defined in claim 1, said actuating shaft having an end cap on its externally projecting end, and further comprising carrying means for grasping said end cap.

3. A toy as defined in claim 2, said end cap having at least one projecting post and said carrying means having at least one projecting hook for grasping and engaging said at least one projecting post.

4. A toy as defined in claim 2, said carrying means comprising a handle.

5. A toy as defined in claim 2, said carrying means comprising a pulley for suspending the toy from a cable.

6. A toy comprising:
a body;
a motor having a rotating shaft with a pinion gear mounted on its distal end;
a switch for actuating said motor;
a gear assembly in mesh with said pinion gear, said gear assembly comprising at least one gear;

a tubular drive shaft projecting from the central portion of said at least one gear;

a rotor having a hub with a cylindrical bore formed therein, said rotor mounted on and loosely frictionally engaging said tubular drive shaft;

an actuating shaft passing through said rotor hub and within said tubular drive shaft and through the central portion of said at least one gear, said actuating shaft having an end cap on its externally projecting end;

an actuating arm operatively associated at one end with the internally projecting end of said actuating shaft, said actuating arm operatively associated at the arm's other end with said switch so that axial movement of said actuating shaft actuates said motor to induce rotation of said tubular drive shaft;

carrying means for grasping said end cap;

whereby axial movement of said actuating shaft actuates said motor to induce rotation of said tubular drive shaft and gradually accelerate said rotor as a result of frictional interaction between the cooperating surfaces of said tubular drive shaft and said cylindrical bore.

7. A toy as defined in claim 6, said end cap having at least one projecting post and said carrying means having at least one projecting hook for grasping and engaging said at least one projecting post.

8. A toy as defined in claim 6, said carrying means comprising a handle.

9. A toy as defined in claim 6, said carrying means comprising a pulley for suspending the toy from a cable.

10. A toy as defined in claim 6, further comprising flashing light means comprising:

a light bulb;

an electrical circuit connected to said light bulb, said electrical circuit comprising a power source and two normally separated contact members;

a tongue associated with one gear of said gear assembly, said tongue contacting said contact members to complete said electrical circuit and activate said light bulb at least once per revolution of said one gear.

11. A toy as defined in claim 6, further comprising an audio means for simulating the sound of a full-scale helicopter in operation.

12. A toy as defined in claim 11, said audio means comprising:

a striker operatively associated with one gear of said gear assembly;

a diaphragm mounted on said body;

whereby said striker strikes said diaphragm to emit a sound as said one gear rotates relative to said body.

13. A toy comprising:

a body;

a motor;

a switch for actuating said motor;

a tubular drive shaft operatively associated with said motor;

a rotor having a hub with a bore formed therein, said rotor mounted on and loosely frictionally engaging said drive shaft;

an actuating shaft passing through said rotor hub and within said tubular drive shaft;

an actuating arm operatively associated at one end with the internally projecting end arm operatively associated at said arm's other end with said switch;

whereby axial movement of said actuating shaft actuates said motor to induce rotation of said tubular drive shaft to thereby induce gradual rotational acceleration of said rotor as a result of frictional interaction between the cooperating surfaces of said drive shaft and said bore.

* * * * *